US008707917B2

(12) United States Patent
Schiepp

(10) Patent No.: US 8,707,917 B2
(45) **Date of Patent: *Apr. 29, 2014**

(54) DEVICE FOR ADJUSTING A CAMSHAFT OF AN INTERNAL COMBUSTION ENGINE

(75) Inventor: Thomas Schiepp, Seitingen-Oberflacht (DE)

(73) Assignee: ETO Magnetic GmbH, Stockach (DE)

( * ) Notice: Subject to any disclaimer, the term of this patent is extended or adjusted under 35 U.S.C. 154(b) by 125 days.

This patent is subject to a terminal disclaimer.

(21) Appl. No.: 13/393,112

(22) PCT Filed: Jul. 30, 2010

(86) PCT No.: PCT/EP2010/004657

§ 371 (c)(1),
(2), (4) Date: Feb. 28, 2012

(87) PCT Pub. No.: WO2011/026545

PCT Pub. Date: Mar. 10, 2011

(65) Prior Publication Data

US 2012/0152193 A1 Jun. 21, 2012

(30) Foreign Application Priority Data

Sep. 1, 2009 (DE) ..... 20 2009 011 804 U

(51) Int. Cl.
*F01L 1/34* (2006.01)

(52) U.S. Cl.
USPC ..... 123/90.16; 123/90.48

(58) Field of Classification Search
CPC ..... F01L 1/12; F01L 1/20
USPC ..... 123/90.48, 90.16, 90.24
See application file for complete search history.

(56) References Cited

U.S. PATENT DOCUMENTS

2010/0126445 A1 5/2010 Schiepp et al.

FOREIGN PATENT DOCUMENTS

DE 19611641 C1 6/1997
DE 102007037232 A1 2/2009

*Primary Examiner* — Zelalem Eshete
(74) *Attorney, Agent, or Firm* — Bachman & LaPointe, P.C.

(57) ABSTRACT

A device for adjusting the camshaft of an internal combustion engine, having a lift profile element (12) which is provided on an axially movable mounted camshaft for conjoint rotation therewith and which provides a control groove, and having a control unit for generating a predetermined axial movement of the camshaft, wherein the control unit has a tappet unit (17) which is movable radially with respect to the camshaft along a movement direction and which is designed for controllable engagement into the lift profile element, and wherein the lift profile element forms a first control groove (16) which is designed to interact with the tappet unit at a first penetration depth so as to describe a first axial movement of the camshaft, and the lift profile element forms a second control groove (18, 22) which is designed to interact with the tappet unit at a second penetration depth, which differs from the first penetration depth, so as to describe a second axial movement, which differs from the first axial movement, of the camshaft.

14 Claims, 3 Drawing Sheets

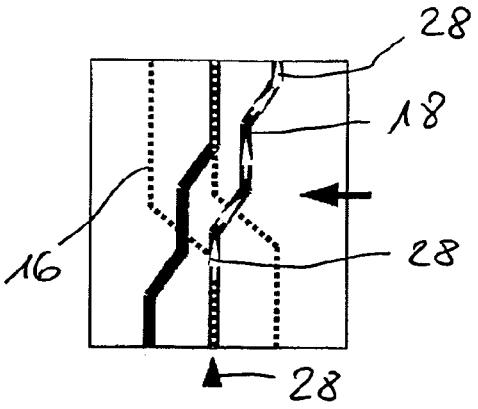
Fig. 9
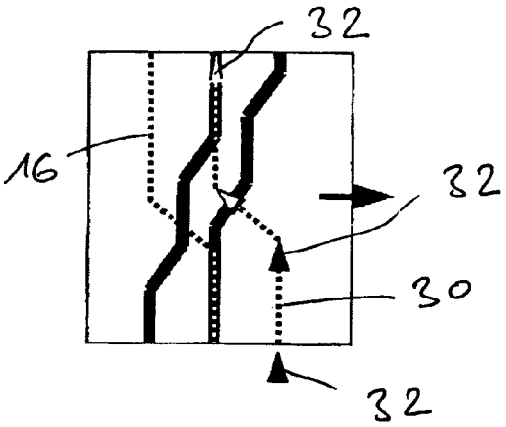
Fig. 10
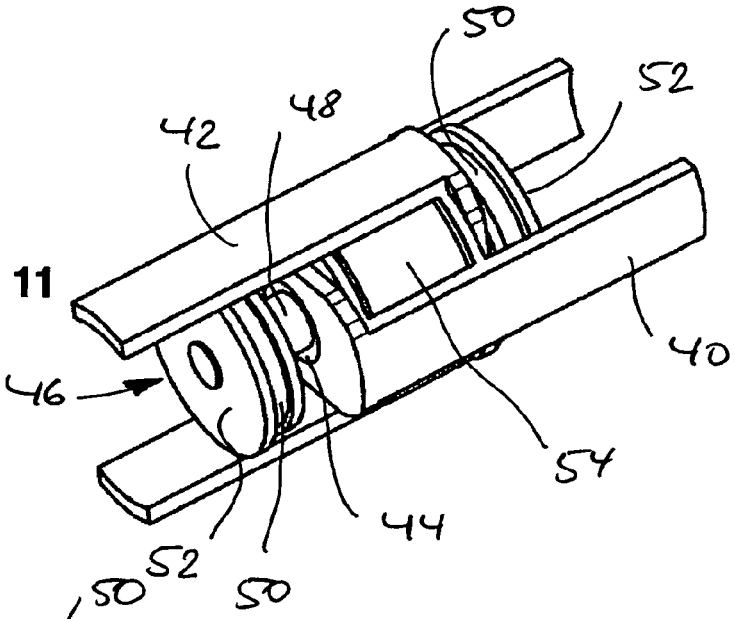
Fig. 11
Fig. 12
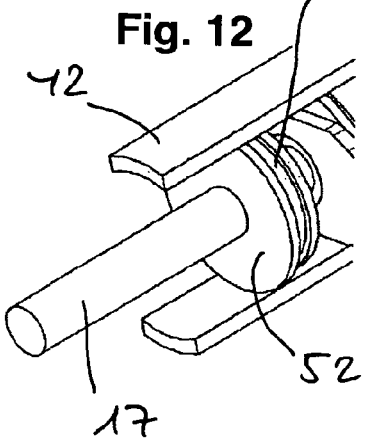

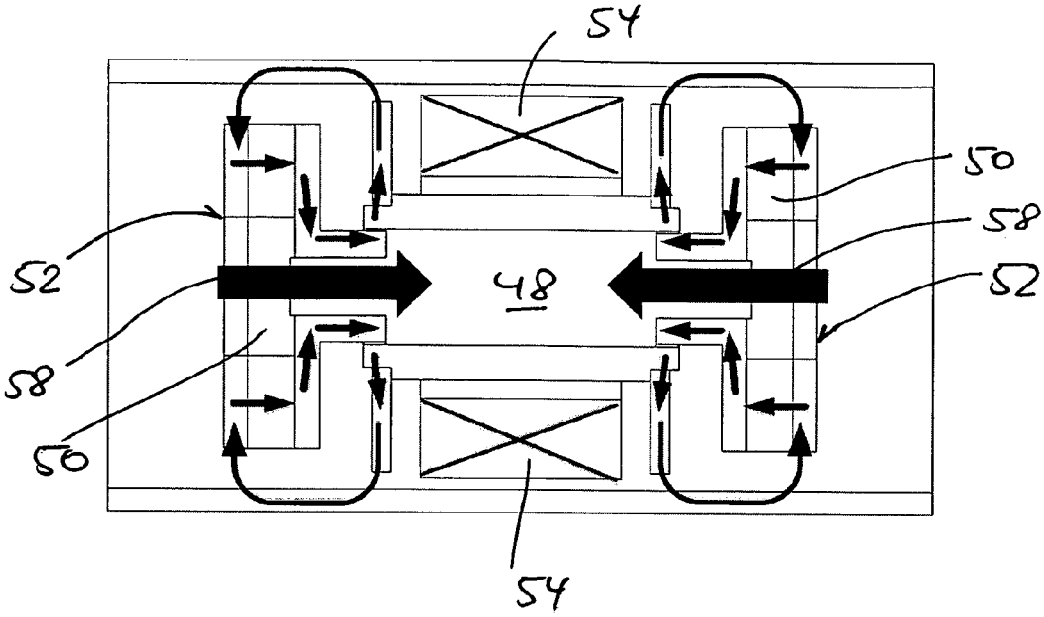
Fig. 13
Fig. 14
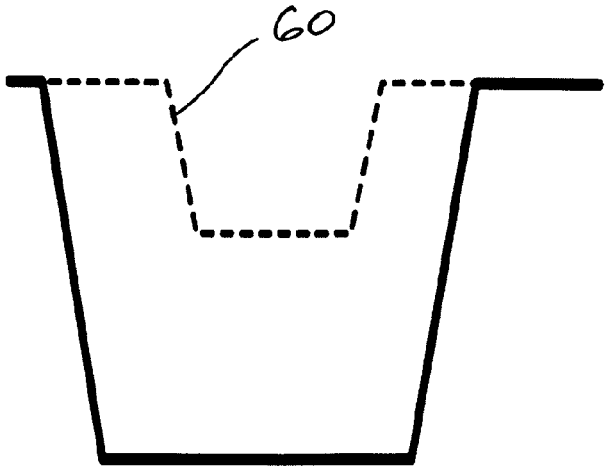

DEVICE FOR ADJUSTING A CAMSHAFT OF AN INTERNAL COMBUSTION ENGINE

BACKGROUND OF THE INVENTION

The present invention relates to a device for adjusting a camshaft of an internal combustion engine according to the introductory clause of the main claim.

Such a device is known from PCT/EP 2008/006417 of the applicant and describes how an actuating element (typically a tappet or suchlike actuating pin) can generate an axial, predetermined adjustment of the camshaft by interacting with a profile associated with the camshaft. This is relevant in particular for such cases of application in which various cam tracks are to be associated in a switchable manner to a combustion engine.

It is known from the prior art here from DE 196 11 641 C1 to provide for each axial movement position of the lift profile arrangement a suitably driven pin which can then generate a respectively intended axial movement. However, this is structurally complex and requires a large amount of installation space at the site of use.

From PCT/EP 2008/006417 which is drawn upon generically, it is known in addition to form the lift profile with a plurality of control grooves for interaction with the electromagnetically driven tappet unit so that the control grooves can penetrate into various groove depths and hence through various penetration depths (to be set in a suitable manner) of the tappet unit, can actuate the camshaft in the respectively desired manner.

However, the tappet unit known from the generic prior art, together with the electromagnetic actuating device interacting therewith, is structurally complex, because to realize the known groove engagement functionality in two penetration depths, the known tappet unit has an arrangement consisting of an inner tappet (of smaller diameter) and an outer tappet, surrounding the latter, of larger diameter, which are associated with the respective control grooves and the corresponding penetration depth.

It is therefore necessary to realize the movement behaviour of the inner and outer tappets of the known device in a suitable manner with regard to construction and technical control, which is costly and potentially prone to error.

The object of the present invention is therefore to improve a device for adjusting a camshaft according to the introductory clause of the main claim with regard to a simplified structural realization, hence potentially increased operating reliability and reduction of the required expenditure on components and assembly.

SUMMARY OF THE INVENTION

The problem is solved by the device with the features of the invention, wherein the profile element is actuated with two control grooves of different penetration depths by a tappet unit which has a constant outer diameter at the engagement end at both penetration depths. This is made possible according to the invention in that the constructed tappet unit (preferably and typically as a single-piece cylindrical body in the manner of a pin) is actuated by a bi- or tri-stable actuator, which moves an armature unit along the movement direction and provides respective reliably actuatable armature positions both for the first penetration depth (with associated first actuating position) and also for the second penetration depth (with an associated second stable actuating position). In addition, provision is made according to the invention that the armature unit according to the invention can be brought into a third actuating position which lies outside the engagement with the first and the second control groove.

Thereby, firstly according to the invention advantageously the realization of the two different penetration depths is made possible with the tappet unit, which can be provided at a (single) axial installation site, and depending on the set activation for the actuating positions accordingly can selectively choose and follow the control grooves (groove paths), whereby then on rotation of the lift profile element the intended axial adjustment (in the respectively desired or set direction) is generated.

On the one hand here it is provided and preferred according to the invention to provide the first and the second control grooves adjacent to each other in a lift profile element which is shared and/or is constructed in one piece, wherein these continue into each other at least partially, in accordance with the further development. In this way, the camshaft adjustment can then take place in the manner of a switch point or respectively branch along a groove path, through suitable penetration depth adjustment, in a particularly reliable manner.

Particularly preferably here the geometry of the control grooves is configured so that an axial movement in a first direction of the camshaft can be generated by means of a first control groove of a first depth, and a subsequent setting of the tappet unit to a second penetration depth then follows the second control groove and returns the camshaft contrary to the first axial direction.

In addition in accordance with a further development, the system is able to be supplemented by a third control groove, which then makes possible an axial movement (and a respective axial return movement) in a second axial direction of the camshaft, opposed to the first direction.

In a structurally particularly preferred manner, the armature unit is realized as a component of the electromagnetic actuating device by means of at least one permanent magnet unit, wherein to achieve a bi- or tri-stable device it is expedient to form the armature unit with a pair of disc-shaped magnets in accordance with a further development, lying axially opposite each other.

In an advantageous manner in accordance with a further development, the permanent magnets can then be used to make possible a currentless-stable state (wherein the term "currentless-stable" is to be understood within the framework of the invention to mean that thereby an actuating position is achieved and held through the armature unit (and the tappet unit connected therewith), without a supply of current to the coil unit being necessary).

In a structurally particularly elegant manner, it is possible in addition to form the electromagnetic actuating device so as to be tri-stable, such that in axial direction a third (preferably stable) position is achieved between two axial end positions determined by an adherence of respective permanent magnet units to a stationary core region), namely on the one hand in that through the attraction effect of permanent magnets on both sides, oppositely directed to each other, a stable intermediate state is achieved, additionally and/or alternatively through an alternating current excitation of the coil means a (stable) central position of the armature unit can be achieved, in which none of the permanent magnet units adheres to a stationary core, but rather permanent pole change through the alternating current signal actuates this state (generating the tri-stability).

It lies within the framework of further preferred embodiments of the invention to allow the tappet unit to interact with the armature unit so that through the action of the permanent magnets provided (preferably on the front face) on the armature unit, the tappet unit (further preferably in one piece, metallic) adheres detachably to the armature unit by magnetic effect, in so far as the greatest possible flexibility exists in application and installation.

It is additionally advantageous then to realize the tappet unit so that the latter has favourable magnetic characteristics axially at one end, in the direction of the permanent magnet unit, for the adherent interaction with the armature unit, at the other end, and for engaging into the profile element or a respective control groove, is materially optimized there in a suitably tough or wear-resistant manner.

As a result, through the present invention, in a surprisingly simple and effective manner, a device is realized for adjusting a camshaft of an internal combustion engine, which combines structural simplicity with a compact construction and a high degree of operating reliability.

BRIEF DESCRIPTION OF THE DRAWINGS

Further advantages, features and details of the invention will emerge from the following description of preferred example embodiments and with the aid of the drawings, which show in:

FIG. 9, FIG. 10: an illustration of the development of the groove course according to FIG. 2, FIG. 6 to illustrate an actuating (FIG. 9) and resetting (FIG. 10) process in the opposite direction with respect to the example of FIG. 2, FIG. 6;

FIG. 11: a perspective view to illustrate the structural assembly of the electromagnetic actuating device for realizing a tri-stable axial actuation between the three actuating positions;

FIG. 12: a detail view of the engagement end of the electromagnetic actuating device to illustrate how a pin-shaped tappet unit, through the action of permanent magnets provided on the front face on the armature unit, adheres detachably to the armature unit of the electromagnetic actuating device;

FIG. 13: a diagrammatic sectional view to illustrate magnetic fluxes and forces on the realization of a central armature position for a tri-stable actuator and FIG. 14: a sectional view through a control groove to illustrate the proportions and the relative geometry for a first (flat) and second (deep) groove depth.

DETAILED DESCRIPTION

Figure 1:
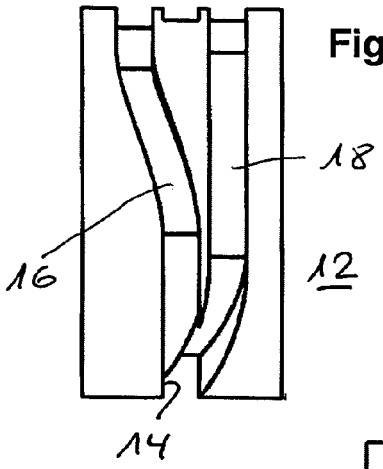
FIG. 1: a lateral view of a lift profile element according to a first embodiment of the invention with partially illustrated control grooves.

With the aid of the illustrations in FIGS. 1 to 4, it is described how the device for adjusting a camshaft according to a first preferred embodiment of the invention generates an axial movement of the camshaft in the direction of the arrows 10 (i.e. to the right in the plane of the drawing).

Figure 2:
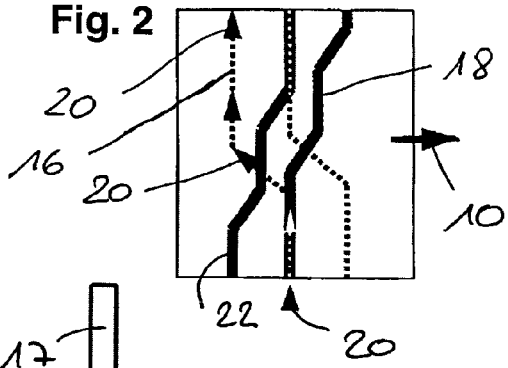
FIG. 2: a radial development of a complete control groove course of the device according to FIG. 1.
Figure 3:
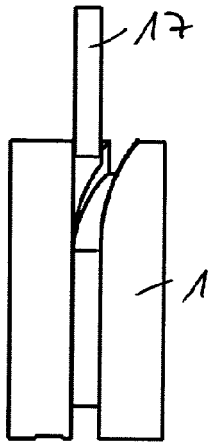
FIG. 3, FIG. 4: views to illustrate how a tappet unit in engaging into the lift profile element of FIG. 1 generates an axial movement in the right-hand direction (wherein the tappet unit is actuated into a first, reduced penetration depth)

Here, the wide view of FIG. 1 (this is incomplete with regard to adjacent further groove paths), shows how with a lift profile element 12 mounted for conjoint rotation on a camshaft (not shown) of a combustion engine, a control groove 14, which (cf. the lower region of the illustration of FIG. 1) branches from a shared groove base into a groove course 16, branching on the left-hand side, of a first, flatter depth (indicated by the dashed line in the development of FIG. 2), and a deeper groove course 18 on the right-hand side (continuous black course in the development of FIG. 2). Accordingly, in the position of FIG. 1 with assumed tappet position in the groove entry 14 it is possible, by suitable selection (setting) of the tappet depth (corresponding to a respective position of the electromagnetic actuating device driving the tappet) to either follow the further path of the flatter groove 16 or respectively of the deeper groove 18.

The example embodiment of FIGS. 1 to 4 illustrates how by bringing a tappet unit 17 into a first (flatter) penetration depth in accordance with the groove depth of the groove 16 a right-hand movement along the arrow 10 is carried out. This movement is indicated by the individual arrows 20 in FIG. 2 and is illustrated in the lateral views of FIG. 3, 4 (which show accordingly further rotation positions of the lift profile element).

Figure 4:
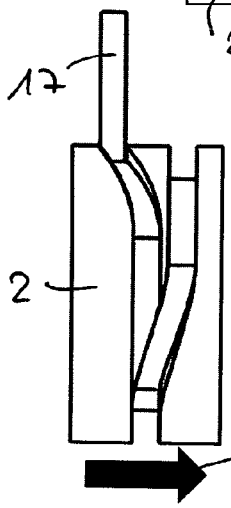
Figure 5:
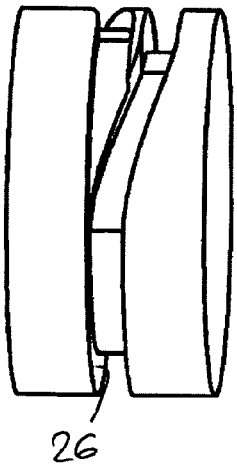
FIG. 5: an illustration of the lift profile element of FIG. 1 in a twisted view relative to FIG. 1.
Figure 6:
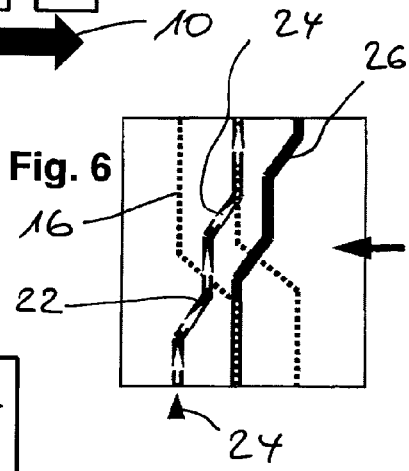
FIG. 6: an illustration analogous to FIG. 2 to illustrate an actuating process (or respectively movement path) along a second control groove for resetting the camshaft from the axial movement position illustrated by FIGS. 2 to 4.
Figure 7:
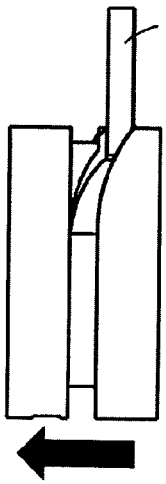
FIG. 7, FIG. 8: illustrations analogous to FIG. 3, 4 to illustrate a tappet engagement into a second penetration depth (FIG. 7) for generating the resetting position, wherein, in accordance with FIG. 8, by the effect of the groove path course, the tappet unit is gradually pressed out from the second movement position.
Figure 8:
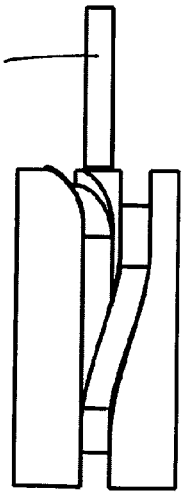

Accordingly, as a result of the continued rotation of the lift profile element (sitting for conjoint rotation on the camshaft) relative to the tappet which stands stationary in radial direction, an axial thrust movement occurs, which moves the lift profile element and consequently the camshaft towards the right in the manner shown in FIG. 4 in arrow direction 10.

FIGS. 5 to 8 illustrate the axial counter-movement, whereby the camshaft can be moved back into the initial position again: This path is shown by a control groove course 22 (continuous black line, illustrates the deep groove base), wherein this is travelled by the tappet unit 17, which is brought into a second penetration depth corresponding to the course 22. The group of arrows 24 illustrates the movement sequence, starting from an initial, axially moved position, wherein in turn the tappet unit 17 would engage into a deepened groove base (this time, however, at the second, deeper penetration depth) according to reference number 26 and remains on the deepened path 22 (along the arrows 24) (via the radial position of FIG. 7), until the initial position according to the movement state of FIG. 1, FIG. 2 (before the movement there) is reached.

In an analogous manner to this pushing to and fro in a first axial movement direction, the further illustration of FIGS. 9, 10 illustrates merely by way of example the pushing to and fro in the opposite axial direction: Thus, starting from the central position, the path of travel would now approximately take place along the groove 18 (arrow group 28), by bringing the tappet unit 17 into the deep (second) penetration position, with the result that a left-hand movement (in the plane of the figure) is actuated. The returning from this adjustment position back into the central position (FIG. 10) then takes place by means of a groove 30 of the first depth (dashed line or respectively arrow group 32), wherein here the tappet unit 17 in turn engages with reduced penetration depth.

In this way, by movement of a pin-like cylindrical tappet unit 17 with only one (preferably constant) outer diameter in the engagement region into the grooves, the same (comparatively complex) axial movement of a camshaft can be induced, as was possible in the prior art by an axial arrangement of outer and inner tappets (or of a plurality of axially adjacent tappets).

With the aid of FIGS. 11 to 13 an example embodiment is illustrated showing how an electromagnetic actuating device can be realized for bringing the tappet unit 17 into the respective actuating positions. In perspective illustration, a housing arrangement is shown, consisting of two U-shaped brackets 40, 42, nested into each other, which provide in their respective connecting region an aperture 44, through which an armature unit 46 is guided. The armature unit 46 has at both ends of a central elongated cylindrical central section 48 a permanent magnet arrangement 50, which (at both ends) carries a disc-shaped permanent magnet and provides an outer surface (support surface) 52, on which the tappet unit 17 (held by permanent magnet effect) then sits in a detachable manner.

By suitable actuation of a stationary coil unit 54, the armature unit is moved between respective axial end positions, wherein these end positions are determined by a stop (and permanent magnetic adhesion state of a respective permanent magnet). To achieve an advantageous tri-stability in accordance with the invention, provision is made in addition that by suitable actuation in impulse form of the coil unit 54, the armature unit is brought into an axial central position, in which none of the permanent magnet units 50 adheres to a housing base or respectively to a magnetically effective core, and thus assumes a stable central position. In addition, in accordance with a further development, it is advantageous to induce this central position of the tri-stability by suitable alternating current actuation of the permanent magnet means. FIG. 13 illustrates corresponding courses of the magnetic flux for the tri-stable central position. It is illustrated how (via corresponding flux-directing elements and geometric configuration of the core) a respective magnetic flux of the permanent magnets 50 is closed by the core so that, in accordance with the two force arrows 58 directed towards each other, a stable central state occurs (generated solely by the permanent magnets exerting respectively an attractive force onto the core region), and generates a stable central position of the armature unit. By supplying the coil unit 54 with current in impulse form, the armature unit can be brought into this position and can be switched therefrom into one of the two end positions; additionally, the mentioned alternating current actuation of the coil unit provides for such a central position.

FIG. 14 illustrates, in this respect supplementing the lateral views or respectively unrolled views of the lift profile elements according to FIGS. 1 to 10, a possible groove geometry with a groove cross-section of a first control groove of a first penetration depth 60 (dashed line), compared with the groove depth or respectively groove geometry of a second control groove of a relatively deeper groove depth. This illustration, as also the diagrammatic illustrations of FIGS. 1 to 10, is purely diagrammatic and not restrictive; rather, the geometries, groove courses and further configurations lying within the scope of the competence of a specialist in the art, would be able to be adapted to a respective purpose of application in a suitable manner.

The invention claimed is:

1. A device for adjusting the camshaft of an internal combustion engine, comprising a lift profile element (12) which is provided on or against an axially movably mounted camshaft for conjoint rotation therewith and which provides a control groove, and having a control unit for generating a predetermined axial movement of the camshaft, wherein the control unit has a tappet unit (17) which is movable radially with respect to the camshaft along a movement direction and which is designed for controllable engagement into the lift profile element, the lift profile element forms a first control groove (16) which is designed to interact with the tappet unit at a first penetration depth so as to describe a first axial movement of the camshaft, and the lift profile element forms a second control groove (18, 22) which is designed to interact with the tappet unit at a second penetration depth, which differs from the first penetration depth, so as to describe a second axial movement, which differs from the first axial movement, of the camshaft, the tappet unit (17) has a constant outer diameter at the engagement end at the first penetration depth and at the second penetration depth, and is driven along the movement direction by an electromagnetic actuating device which provides in an actuatable manner a first stable actuating position for the first penetration depth, a second stable actuating position for the second penetration depth, and a third actuating position for a state in which the tappet unit does not engage into the first and second control groove.

2. The device according to claim 1, wherein the tappet unit (17) is constructed as a body in a single piece, having a constant outer diameter.

3. The device according to claim 1, wherein the first and the second control groove are provided adjacent to each other in a lift profile element (12).

4. The device according to claim 3, wherein the first and the second control groove in the lift profile element continue into each other at least partially.

5. The device according to claim 1, wherein the tappet unit is constructed so as to be pin-shaped and cylindrical.

6. The device according to claim 1, wherein the first and the second control groove are constructed so that by the action of the control unit actuating the tappet unit, the camshaft can be adjusted by means of the first axial movement and the second axial movement from an initial position into a first axially moved position and back into the initial position.

7. The device according to claim 6, wherein the lift profile element has a third control groove adjacent to and/or partially overlapping with the first and the second control groove, and the third control groove describes a third axial movement of the camshaft, wherein the third control groove is constructed and/or arranged so that by the action of the control unit actuating the tappet unit, the camshaft can be moved from the initial position or from the first axially moved position into a second axially moved position, which is different from the initial position and the first axially moved position.

8. The device according to claim 7, wherein the first, second and third control groove is constructed so that through the action of the control unit regulating the tappet unit, the camshaft can be adjusted as desired between three axial movement positions which are different from each other.

9. The device according to claim 1, wherein the electromagnetic actuating device has an armature unit (46) movable relative to a stationary coil unit and as a reaction to a supply of current thereof along a movement longitudinal axis between at least two actuating positions, and which has engagement means on the end side for interaction with the tappet unit, wherein the at least two actuating positions are currentless-stable actuating positions.

10. The device according to claim 9, wherein the electromagnetic actuating device is constructed for bringing the armature unit into a third actuating position, wherein the third actuating position lies along the direction of the movement longitudinal axis between the first and the second actuating position.

11. The device according to claim 10, wherein the armature unit has permanent magnet means (50) in the form of at least one, preferably two permanent magnets, which are constructed for interaction with a stationary core region and for generating and/or holding at least one of the currentless-stable actuating positions.

12. The device according to claim 9, wherein the tappet unit (17) is fastened detachably to the armature unit (46) by means of the permanent magnet effect.

13. The device according to claim 1, wherein along the movement direction, the tappet unit has undetachably connected materials having different strength- and/or magnetic characteristics.

14. The device according to claim 1, wherein the electromagnetic actuating device has a housing which is constructed as a pair of bracket-shaped housing elements (40, 42), provided nested into each other and/or against each other, through which an armature unit (46), driving the tappet unit, extends axially.

* * * * *